US009138869B2

(12) United States Patent
McNeal et al.

(10) Patent No.: US 9,138,869 B2
(45) Date of Patent: Sep. 22, 2015

(54) LARGE DIAMETER CUTTING TOOL

(71) Applicants: Kelley McNeal, Marlborough, MA (US); Charles Deleuze, Shrewsbury, MA (US); Andrew B. Schoch, Northborough, MA (US); Siddharth Srinivasan, Chelmsford, MA (US)

(72) Inventors: Kelley McNeal, Marlborough, MA (US); Charles Deleuze, Shrewsbury, MA (US); Andrew B. Schoch, Northborough, MA (US); Siddharth Srinivasan, Chelmsford, MA (US)

(73) Assignees: SAINT-GOBAIN ABRASIVES, INC., Worcester, MA (US); SAINT-GOBAIN ABRASIFS (FR)

( * ) Notice: Subject to any disclaimer, the term of this patent is extended or adjusted under 35 U.S.C. 154(b) by 70 days.

(21) Appl. No.: 14/012,171

(22) Filed: Aug. 28, 2013

(65) Prior Publication Data

US 2014/0073230 A1 Mar. 13, 2014

Related U.S. Application Data

(60) Provisional application No. 61/694,142, filed on Aug. 28, 2012.

(51) Int. Cl.

| | |
|---|---|
| ***B24D 5/12*** | (2006.01) |
| ***B24D 3/06*** | (2006.01) |
| ***B24D 5/04*** | (2006.01) |

(52) U.S. Cl.

CPC .. *B24D 5/12* (2013.01); *B24D 3/06* (2013.01); *B24D 5/04* (2013.01); *B24D 5/123* (2013.01)

(58) Field of Classification Search

CPC ..... B24B 37/24; B24B 37/22; B24D 3/00; B24D 3/28; B24D 3/32; B24D 5/04; B24D 5/066; B24D 5/08; B24D 5/12; B24D 5/123; B24D 5/14; B24D 3/06

USPC ..... 51/296, 297, 307; 451/526, 533, 541, 451/542, 544, 546

See application file for complete search history.

(56) References Cited

U.S. PATENT DOCUMENTS

| | | | | |
|---|---|---|---|---|
| 2,725,286 | A * | 11/1955 | Coes, Jr. | 51/298 |
| 3,524,286 | A * | 8/1970 | Wohrer | 51/298 |
| 3,631,638 | A * | 1/1972 | Yoshikawa et al. | 51/295 |

(Continued)

FOREIGN PATENT DOCUMENTS

| | | | |
|---|---|---|---|
| JP | 06-063870 | A | 3/1994 |
| KR | 10-0841966 | B1 | 6/2008 |
| KR | 10-0913352 | B1 | 8/2009 |

OTHER PUBLICATIONS

International Search Report for PCT/US2013/057014 dated Nov. 21, 2013, 4 pgs.

(Continued)

*Primary Examiner* — Timothy V Eley

(74) *Attorney, Agent, or Firm* — Abel Law Group, LLP; Joseph P. Sullivan

(57) ABSTRACT

An abrasive cutting tool includes a body in a shape of a large diameter disk having an outer diameter of at least about 60 centimeters. The body has an aspect ratio defined as a ratio (D:T) between the outer diameter to an axial thickness of the body of at least about 10:1. The body includes an abrasive portion having a bond material and abrasive particles contained within the bond material. The abrasive portion also includes a first filler having iron and sulfur with an average particle size of not greater than about 40 microns. The body also includes a reinforcing member and a Thermal Adhesion Factor (TAF) of at least about 30%.

21 Claims, 5 Drawing Sheets

(56) References Cited

U.S. PATENT DOCUMENTS

| | | | | |
|---|---|---|---|---|
| 3,686,800 | A * | 8/1972 | Rue et al. | 451/541 |
| 4,007,020 | A | 2/1977 | Church et al. | |
| 4,062,153 | A * | 12/1977 | Malm | 451/544 |
| 4,218,851 | A * | 8/1980 | Rue | 451/342 |
| 5,143,522 | A | 9/1992 | Gibson et al. | |
| 5,584,755 | A * | 12/1996 | Alfer et al. | 451/544 |
| 6,071,185 | A * | 6/2000 | Genau et al. | 451/541 |
| 6,352,567 | B1 | 3/2002 | Windisch et al. | |
| 6,475,253 | B2 | 11/2002 | Culler et al. | |
| 7,115,029 | B2 * | 10/2006 | Lang et al. | 451/544 |
| 7,661,247 | B2 * | 2/2010 | Schwabel et al. | 53/472 |
| 8,113,920 | B2 * | 2/2012 | Gissing | 451/342 |
| 8,808,413 | B2 * | 8/2014 | Francois et al. | 51/307 |
| 2003/0205003 | A1 | 11/2003 | Carman et al. | |
| 2006/0128292 | A1 | 6/2006 | Stuckenholz et al. | |
| 2008/0072500 | A1 | 3/2008 | Klett et al. | |
| 2008/0236051 | A1 | 10/2008 | Schwabel et al. | |
| 2010/0190424 | A1 | 7/2010 | Francois | |
| 2011/0027564 | A1 | 2/2011 | Francois et al. | |
| 2011/0041413 | A1 | 2/2011 | Francois et al. | |
| 2011/0111678 | A1 * | 5/2011 | Zhang et al. | 451/548 |
| 2012/0149289 | A1 * | 6/2012 | Lee et al. | 451/541 |
| 2013/0244542 | A1 * | 9/2013 | Meerveld et al. | 451/28 |
| 2014/0033617 | A1 * | 2/2014 | Li et al. | 51/308 |
| 2014/0137482 | A1 * | 5/2014 | Li et al. | 51/309 |
| 2014/0187129 | A1 * | 7/2014 | Sivasubramanian et al. | 451/541 |

OTHER PUBLICATIONS

U.S. Appl. No. 13/911,331, filed Jun. 6, 2013, Inventor: Siddharth Srinivasan.

* cited by examiner

LARGE DIAMETER CUTTING TOOL

This application claims priority to and the benefit of U.S. Prov. App. No. 61/694,142, filed Aug. 28, 2012, and is incorporated herein by reference in its entirety.

BACKGROUND OF THE INVENTION

1. Field of the Disclosure

The present invention relates in general to abrasive articles and, in particular, to large diameter cutting tools.

2. Description of the Related Art

Abrasive wheels are typically used for cutting, abrading, and shaping of various materials, such as stone, metal, glass, plastics, among other materials. Generally, the abrasive wheels can have various phases of materials including abrasive grains, a bonding agent, and some porosity. Depending upon the intended application, the abrasive wheel can have various designs and configurations. For example, for applications directed to the finishing and cutting of metals, some abrasive wheels are fashioned such that they have a particularly thin profile for efficient cutting.

However, given the application of such wheels, the abrasive articles are subject to fatigue and failure. In fact, the wheels may have a limited time of use of less than a day depending upon the frequency of use. Accordingly, the industry continues to demand abrasive wheels capable of improved performance.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

The following is directed to abrasive tools having abrasive particles contained within a bond material for cutting workpieces. Certain embodiments herein are directed to bonded abrasive wheels, including cut off wheels, which may be used for cutting metal workpieces, including metals of titanium or stainless steel. However, the features of the embodiments herein may be applicable to other abrasive technologies, including for example, coated abrasives and the like.

The abrasive article can be made by forming a mixture of components or precursor components that may be part of the final abrasive article. For example, the mixture can include components of the final abrasive article, such as abrasive particles, bond material, filler, and a combination thereof. In one embodiment, the mixture can include a first type of abrasive particle. A type of abrasive particle can be defined by at least a composition, a mechanical property (e.g., hardness, friability, etc.), particle size, a method of making, and a combination thereof.

The abrasive tools may utilize abrasive portions of abrasive grains contained within a matrix material for cutting, abrading, and finishing of workpieces. Certain embodiments herein are directed to large-diameter abrasive wheels incorporating one or more reinforcing members within the body of the tool that are particularly suited for cutting and/or shaping metal.

Figure 1:
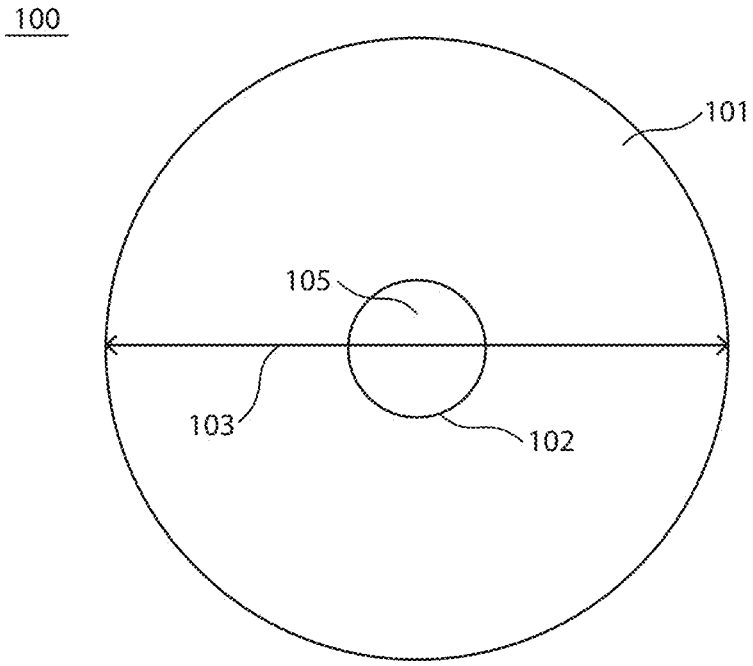
FIG. 1 includes an illustration of an abrasive tool in accordance with an embodiment.

FIG. 1 includes an illustration of an abrasive tool in accordance with an embodiment. Notably, the abrasive tool 100 includes a body 101 having a generally circular shape as viewed in two dimensions. It will be appreciated, that in three-dimensions the tool has a certain thickness such that the body 101 has a disk-like or a cylindrical shape. As illustrated, the body can have an outer diameter 103 extending through the center of the tool, which can be particularly large, having a dimension of at least about 45 cm. In other applications, the body 101 can have an outer diameter 103, such as on the order of at least about 60 centimeters, at least about 75 centimeters, or even at least 100 centimeters. Particular abrasive tools utilize a body 101 having an outer diameter 103 within a range between 45 centimeters and about 200 centimeters, such as between 45 cm and about 175 cm, and more particularly between about 45 centimeters and about 150 centimeters.

As further illustrated, the abrasive tool 100 can include a central opening 105 defined by an inner circular surface 102 about the center of the body 101. The central opening 105 can extend through the entire thickness of the body 101 such that the abrasive tool 100 can be mounted on a spindle or other machine for rotation of the abrasive tool 100 during operation.

Figure 2:
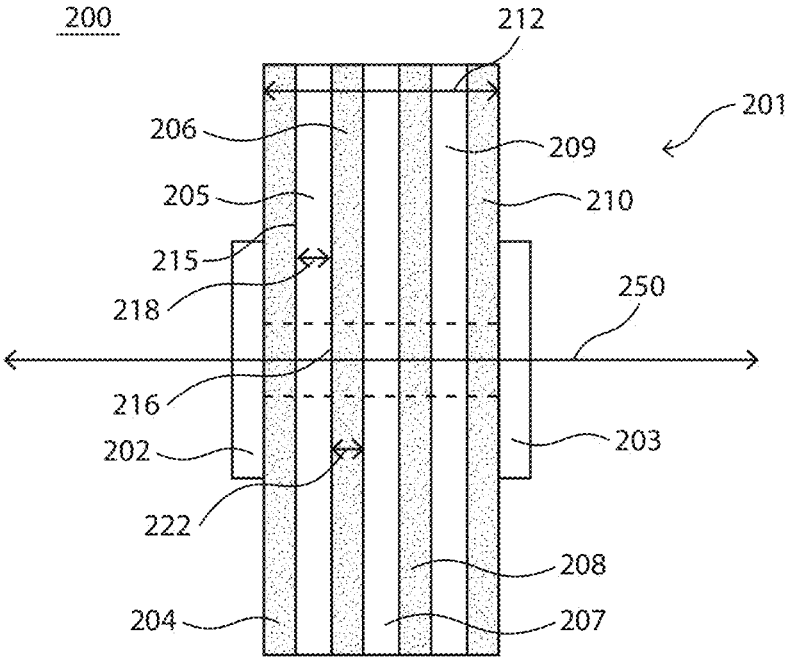
FIG. 2 includes a cross-sectional illustration of a portion of an abrasive tool in accordance with an embodiment.

FIG. 2 includes a cross-sectional illustration of a portion of an abrasive tool in accordance with an embodiment. The abrasive body 201 can be a composite article including a combination of portions of different types of material. In particular, the body 201 can include abrasive portions 204, 206, 208, and 210 and reinforcing members 205, 207, and 209. The abrasive tool 200 can be designed such that the reinforcing members 205, 207, and 209 can be placed within the body such that they are spaced apart from each other, and therein, separate each of the abrasive portions 204, 206, 208, and 210 from each other. That is, the abrasive tool 200 can be formed such that the reinforcing members 205, 207, and 209 are spaced apart from each other laterally through the thickness 212 of the body 201 and separated by abrasive portions 206 and 208. As will be appreciated, in such a design the abrasive portions 206 and 208 can be disposed between the reinforcing members 205, 207, and 209.

As further illustrated, the reinforcing members 205, 207, and 209 can be substantially planar members having first planar faces and second planar faces. For example, the reinforcing member 205 can be formed such that it is a planar member having a first major surface 215 and a second major surface 216. Moreover, the body 201 can have a design such that the abrasive portions 204, 206, 208, and 210 can overlie the major surface of the reinforcing members 205, 207, and 209. For example, the abrasive portion 204 can overlie the first major surface 215 of the reinforcing member 205 and the abrasive portion 206 overlies the second major surface 216 of the reinforcing member 205. In particular instances, the body 201 can be formed such that the abrasive portions 204 and 206 cover essentially the entire surface area of the first major surface 215 and second major surface 216, respectively. Accordingly, the abrasive portions 204 and 206 can directly contact (i.e. abut) the reinforcing member 205 on either sides at the first and second major surfaces 215 and 216.

Notably, the abrasive body 201 can be designed such that the reinforcing members 205, 207, and 209 can extend through a majority of the diameter 103 of the body 201. In particular instances, the reinforcing members 205, 207, and 209 can be formed such that they extend through at least about 75%, such as at least about 80%, or even the entire diameter 103 of the body 201.

In accordance with an embodiment, the body 201 is formed such that it can have an average thickness 212 measured in a direction parallel to the axial axis 250 extending through the center of the central opening 105. The average thickness 212 of the body 201 can be particularly thin such that it is suitable for cutting metal workpieces. For example, the average thickness of the body 201 can be not greater than about 3 centimeters. In other embodiments, the average thickness 212 of the body 201 can be not greater than about 2.5 centimeters, such as not greater than about 2 centimeters, or even not greater than about 1.5 centimeters. Still, certain embodiments may utilize an average thickness 212 within a range between about 0.5 centimeters and about 3 centimeters, such as between about 0.5 centimeters and about 2 centimeters.

The disk may have an aspect ratio defined as a ratio (D:T) between the outer diameter 103 to an axial thickness 212 of the body. The ratio (D:T) can be at least about 10:1, such as at least about 20:1, at least about 50:1, or even at least about 75:1. Certain embodiments utilize an aspect ratio within a range between about 10:1 and about 125:1, such as between about 20:1 and about 125:1.

In further reference to the reinforcing members 205, 207, and 209, such members can be made of an organic material, inorganic material, and a combination thereof. For example, the reinforcing members 205, 207, and 209 can be made of an inorganic material, such as a ceramic, a glass, quartz, or a combination thereof. Particularly suitable materials for use as the reinforcing members 205, 207, and 209 can include glass materials, incorporating fibers of glass materials, which may include oxide-based glass materials.

Some suitable organic materials for use in the reinforcing members 205, 207, and 209 can include phenolic resin, polyimides, polyamides, polyesters, aramids, and a combination thereof. For example, in one particular embodiment, the reinforcing members 205, 207, and 209 can include Kevlar™, a particular type of aramid.

Additionally, the reinforcing members 205, 207, and 209 can include a fibrous material having a coating overlying and bonded directly to the external surfaces of the fibers. The coating can be an organic material, inorganic material, or a combination thereof. Certain abrasive tools can use reinforcing members 205, 207, and 209 utilizing fibers having a coating of an organic material, which may be a natural organic material or a synthetic organic material, such as a polymer, which may aid bonding between the reinforcing member and the abrasive portion. Some suitable organic coating materials can include resins, which may be thermosets, thermoplastics, or a combination thereof. Particularly suitable resins can include phenolics, epoxies, polyesters, cyanate esters, shellacs, polyurethanes, and a combination thereof. In one particular instance, the abrasive tool incorporates a reinforcing member comprising phenolic resin-coated glass fibers.

The reinforcing members 205, 207, and 209 can include a plurality of fibers that are woven together. The fibers can be woven or stitched together in a variety of manners. In certain instances, the reinforcing members can be woven together such that a pattern is formed, including fibers extending primarily in two perpendicular directions.

The reinforcing members 205, 207, and 209 can have an average thickness 218 that is defined as the distance between the first major surface 215 and the second major surface 216 of the reinforcing member 205. The average thickness 218 can be at least about 0.5 mm, at least about 1 mm, at least about 1.5 mm, at least about 2 mm. Alternatively, the average thickness 218 can be not greater than about 2.5 mm, not greater than about 2 mm, or even not greater than about 1.5 mm. It will be appreciated that the reinforcing member may have a thickness within a range between any of the above-noted minimum and maximum values.

In relative percentages, depending upon the design of the abrasive article, the reinforcing members can be formed to have certain dimensions such that they compose a certain percentage of the total average thickness of the body. For example, the reinforcing member 205 can have an average thickness 218 that is at least about 3% of the total average thickness 212 of the body 201. In other instances, the reinforcing member 205 can have an average thickness 218 that is at least about 5%, such as at least about 8%, or even at least about 10% of the total average thickness 212 of the body 201. Alternatively, the average thickness of the body can be not greater than about 18%, not greater than about 15%, or even not greater than about 12% of the total average thickness 212 of the body 201. Certain reinforcing members can have an average thickness 218 that is within a range between about 3% and about 15% of the total average thickness 212 of the body 201. It will be appreciated that the reinforcing member may have a thickness within a range between any of the above-noted minimum and maximum values.

In accordance with embodiments herein, the abrasive tool 200 is formed such that the body 201 includes abrasive portions 204, 206, 208, and 210. Reference will be made in the following paragraphs to the abrasive portion 204, however it will be appreciated that all of the identified abrasive portions can include the same features. The abrasive portion 204 can be a composite material having abrasive grains contained within a matrix material and further comprising a particular composition and type of porosity.

The abrasive grains can include a particularly hard material suitable for abrading and material removal applications. For example, the abrasive grains can have a Vickers hardness of at least about 5 GPa. The hardness of the abrasive grains can be greater in some tools, such that the abrasive grains have a Vickers hardness of at least about 10 GPa, at least about 20 GPa, at least about 30 GPa, or even at least about 50 GPa. It will be appreciated that the abrasive grains may have a hardness within a range between any of the above-noted minimum and maximum values.

As further illustrated in FIG. 2, the body can be formed such that it incorporates reinforcing members 202 and 203 that abut the outer surfaces of the abrasive portions 204 and 210 about the central opening 105. In certain designs, the reinforcing members 202 and 203 can extend for a portion of the outer diameter 103, such as half the outer diameter 103 of the abrasive body 201. Provision of the reinforcing members 202 and 203 about the central opening 105 facilitates reinforcement of the body 201 at a location where the abrasive tool 200 is intended to be affixed to a spindle or machine. As will be appreciated, the reinforcing members 202 and 203 can have the same features as the reinforcing members 205, 207, and 209.

In other embodiments, the reinforcing member may comprise not greater than about 20 vol % of a total volume of the body, not greater than about 17 vol % not greater than about 15 vol %; at least about 5 vol %, at least about 7 vol %, at least about 9 vol %. It will be appreciated that the reinforcing member may comprise a volume within a range between any of the above-noted minimum and maximum values.

In still other embodiments, a volumetric ratio VR of the abrasive portion to the reinforcing member is at least about 5, where VR=(volume of reinforcing member)/(volume of abrasive portion). In some versions, VR is at least about 10, at least about 15, not greater than about 20, not greater than about 15, or even not greater than about 10. It will be appreciated that the reinforcing member may comprise a volumetric ratio within a range between any of the above-noted minimum and maximum values.

Embodiments of the reinforcing member may comprise an opening, a plurality of openings, an opening extending axially through at least a portion of a thickness thereof, an opening extending entirely through the thickness of the reinforcing member, an opening having a perimeter and defining a polygonal two-dimensional shape.

The reinforcing member may comprise an opening that defines an open area of at least about 10 $mm^2$ within a major plane of the reinforcing member; and/or the opening defines an open area of not greater than about 20 $mm^2$ within a major plane of the reinforcing member.

Embodiments of the reinforcing member may comprise fiber bundles having a warp filament diameter of less than about 17 microns, less than about 15 microns, less than about 13 microns. It will be appreciated that the reinforcing member may comprise a size within a range between any of the above-noted minimum and maximum values.

In addition, Differential Scanning calorimetry (DSC) measures the temperatures and heat flows associated with transitions in materials as a function of time and temperature in a controlled atmosphere. These measurements provide quantitative and qualitative information about physical and chemical changes that involve endothermic or exothermic processes, or changes in heat capacity. DSC may be measured using an approximately 25 g sample of fiberglass in a nitrogen environment. The sample may be ramped to 400° C. at a ramp of 10° C./min and held for 10 minutes. For example, the reinforcing member may comprise a DSC enthalpy of reaction less than about 29 J/g, less than about 25 J/g, less than about 21 J/g, less than about 17 J/g. It will be appreciated that the reinforcing member may comprise a value within a range between any of the above-noted minimum and maximum values.

In other embodiments, the reinforcing member may comprise a DSC enthalpy of crystallization of less than about 30 J/g, less than about 25 J/g, less than about 20 J/g, less than about 15 J/g, less than about 10 J/g, less than about 5 J/g, less than about 3 J/g. It will be appreciated that the reinforcing member may comprise a value within a range between any of the above-noted minimum and maximum values.

Figure 3:
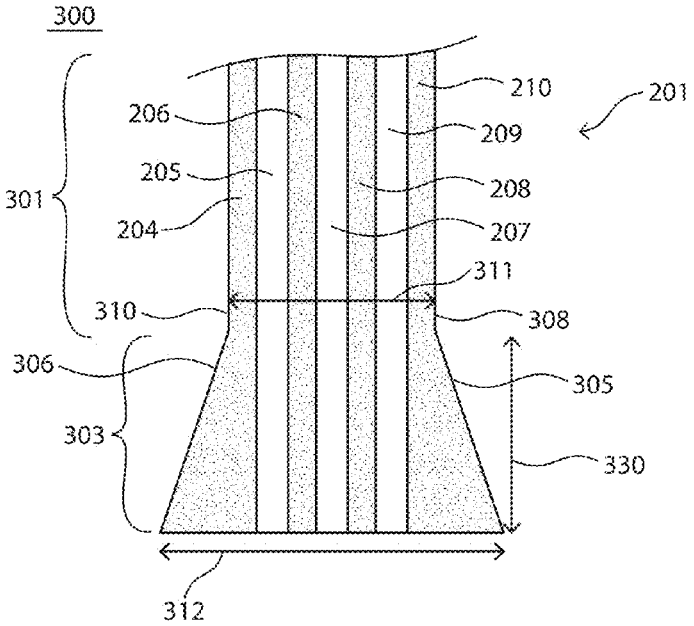
FIG. 3 includes a cross-sectional illustration of a portion of an abrasive tool in accordance with an embodiment.

FIG. 3 includes a cross-sectional illustration of a portion of an abrasive tool in accordance with an embodiment. The portion of the illustrated abrasive tool 300 includes an outer circumference of an abrasive tool formed in accordance with an embodiment. Particularly, the portion of the abrasive tool 300 can have a body 201 including abrasive portions 204, 206, 208, and 210 previously described. Moreover, the abrasive body 201 includes reinforcing members 205, 207, and 209 disposed between the abrasive portions 204, 206, 208, and 210 as previously described.

Notably, the body 201 is formed such that it has a flat region 301 proximate to the center of the wheel and surrounding the central opening 105, and a tapered region 303 at the outer edge of the body 201. As illustrated, the tapered region 303 is formed such that it has an average thickness 312 measured at the outer diameter of the body 201 that is significantly greater than the average thickness 311 of the body 201 within the flat region 301. The formation of the tapered region 303 is facilitated by the extension of a tapered edge 305 of the abrasive portion 210 that extends at an angle to the external surface 308 of the flat region 301 of the abrasive portion 210. The tapered region 303 is further defined by a tapered surface 306 of the abrasive portion 204, which extends at an angle to the surfaces 310 of the abrasive portion 204. As illustrated, the tapered region 303 can form a rim around the outer diameter of the wheel, wherein the tapered surfaces 305 and 306 extend at an angle axially outward from the surfaces 308 and 310, respectively. The tapered surfaces 305 and 306 can extend at an angle to a radius extending from the center of the body substantially parallel to the surfaces 308 and 310, and moreover, the tapered surfaces 305 and 306 can extend at an angle to an axial axis 250 extending through the center of the body 201.

According to some embodiments, the tapered region 303 can extend circumferentially around a portion of a periphery of the body 201. Certain designs may utilize a tapered region 303 that extends throughout the entire circumference of the body 201. While reference is made herein to abrasive articles incorporating a tapered region 303, it will be appreciated, that a tapered region 303 may not necessarily be present for certain abrasive articles.

As illustrated, the tapered region 303 can extend radially from the flat region 301 of the body 201. Embodiments herein may form a tapered region 303 having a length 330, as measured in a direction parallel to a radius extending from the center of the body 201, which can be a particular percentage of the dimension of the outer diameter 103 of the body 201. For example, the tapered region 303 can have a length 330 that is at least about 5% of the dimension of the outer diameter 103. In other cases, depending upon the intended application, the body 201 can have a tapered region 303 having a length 330 of at least about 10%, such as at least about 15%, at least about 20%, at least about 30%, or even at least about 35%, of the dimension of the outer diameter 103. Particular embodiments can utilize a tapered region 303 wherein the length 330 is within a range between about 5% and about 50%, and particularly between about 5% and about 35%, or even more particularly between about 5% and about 20% of the outer diameter 103.

In other terms, the length 330 of the tapered region can be at least about 10 centimeters. In some embodiments, the length 330 of the tapered region 303 can be greater, such as at least about 13 centimeters, at least about 15 centimeters, or even at least about 20 centimeters. Still, particular embodiments herein can utilize a tapered region 303 having a length 330 within a range between about 10 centimeters and about 30 centimeters, such as between about 10 centimeters and about 20 centimeters.

The abrasive portion may comprise a filler contained within the abrasive portion. The filler may comprise a first filler comprising iron and sulfur. The first filler may comprise pyrite ($FeS_2$). Alternatively, the first filler may consist essentially of pyrite.

In a particular embodiment, the first filler may comprise at least about 30 vol % of a total volume of the fillers within the abrasive portion. In certain instances, the filler content may be greater, such as at least about 40 vol %, or even at least about 50 vol %. In another non-limiting embodiment, the filler content can be not greater than about 80 vol % of the total volume of the fillers within the abrasive portion, such as not greater than about 70 vol %, or even not greater than about 60 vol %. The abrasive portion can have a first filler content within a range between any of the minimum and maximum percentages noted above.

In some embodiments, the average particle size of the first filler can be not greater than about 40 microns. In some examples, the average particle size of the first filler can be not greater than about 30 microns, such as not greater than about 20 microns, not greater than about 15 microns, not greater than about 10 microns, or even not greater than about 8 microns. In other non-limiting embodiments, the first filler can have an average particle size of at least about 1 micron, such as at least about 2 microns, or even at least about 3 microns. The average particle size of the first filler can be within a range between any of the minimum and maximum values noted above.

In other embodiments, the abrasive portion may comprise a second filler. The second filler may comprise potassium. The second filler may further comprise aluminum, fluoride or a combination thereof. For example, the second filler may comprise a compound including potassium, aluminum, and fluoride. In one particular instance, the second filler may consist essentially of $KAlF_4$.

In some embodiments, the abrasive portion may comprise a greater content of the first filler (vol %) as compared to a content of the second filler (vol %). The abrasive portion may comprise a ratio (V1/V2) of at least about 1, wherein V1 represents a content of the first filler (vol %) within the abrasive portion and V2 represents a content of the second filler (vol %) within the abrasive portion. In other examples, the ratio (V1/V2) may be at least about 1.1, or even at least about 1.2. In other non-limiting embodiments, the ratio (V1/V2) may be not greater than about 3, such as not greater than about 2.6, not greater than about 2.2, or even not greater than about 1.8, or even not greater than about 1.6. The ratio (V1/V2) can be within a range between any of the minimum and maximum values noted above.

In a particular embodiment, the second filler can be at least about 20 vol % of a total volume of the fillers. For example, the second filler can be at least about 30 vol % of the total volume of the fillers, such as at least about 35 vol %, or even at least about 40 vol %. In certain non-limiting examples, the second filler can be not greater than about 70 vol % of the total volume of the fillers, such as not greater than about 60 vol %, or even not greater than about 50 vol %. The second filler content can be within a range between any of the minimum and maximum values noted above.

In some instances, the second filler may comprise an average particle size of not greater than about 75 microns. For example, the average particle size of the second filler can be not greater than about 65 microns, such as not greater than about 55 microns, or even not greater than about 45 microns. In other non-limiting embodiments, the average particle size of the second filler can be at least about 5 microns, such as at least about 15 microns, or even at least about 25 microns. The second filler average particle size can be within a range between any of the minimum and maximum values noted above.

In other embodiments, the abrasive portion may comprise a third filler different than the first filler. The third filler may comprise calcium. The third filler may further comprise oxygen, or a compound including calcium and oxygen. The third filler may consist essentially of CaO.

Examples of the third filler may comprise an average particle size of not greater than about 75 microns. In particular instances, the third filler average particle size can be not greater than about 65 microns, such as not greater than about 55 microns. Non-limiting embodiments may include a third filler having an average particle size of at least about 15 microns, such as at least about 25 microns, or even at least about 35 microns. The third filler average particle size can be within a range between any of the minimum and maximum values noted above.

The abrasive portion also may comprise a greater content of the first filler (vol %) as compared to the content of the third filler (vol %). The abrasive portion may comprise a ratio (V1/V3) of at least about 1, wherein V1 represents a content of the first filler (vol %) within the abrasive portion, and V3 represents a content of the third filler (vol %) within the abrasive portion. In other examples the ratio (V1/V3) may be at least about 3, such as at least about 6, at least about 10, at least about 15, or even at least about 18. In other non-limiting embodiments, the ratio (V1/V3) can be not greater than about 40, such as not greater than about 35, not greater than about 30, not greater than about 25, or even not greater than about 23. The ratio (V1/V3) can be within a range between any of the minimum and maximum values noted above.

Still other embodiments of the abrasive portion may comprise a greater content of a second filler (vol %) as compared to a content of the third filler (vol %). The abrasive portion may comprise a ratio (V2/V3) of at least about 1, wherein V2 represents a content of the second filler (vol %) within the abrasive portion and V3 represents a content of the third filler (vol %) within the abrasive portion. In some examples, the ratio (V2/V3) can be at least about 3, at least about 6, at least about 12, or even at least about 15. Non-limiting examples may include the ratio (V2/V3) at not greater than about 40, such as not greater than about 35, not greater than about 30, not greater than about 25, or even not greater than about 20. The ratio (V2/V3) can be within a range between any of the minimum and maximum values noted above.

In a particular embodiment, the third filler can be at least about 1 vol % of a total volume of the fillers. In certain instances, the third filler can be greater, such as at least about 1.5 vol %, or even at least about 2 vol %. In another non-limiting embodiment, the third filler can be not greater than about 5 vol % of the total volume of the fillers, such as not greater than about 4 vol %, not greater than about 3 vol %, or even not greater than about 2 vol %. The fillers can have a third filler content within a range between any of the minimum and maximum values noted above.

In other embodiments, the abrasive portion may comprise a fourth filler. In other examples, the fourth filler may comprise an aggregate including, for example, cement, including more particularly Portland cement, and/or calcium silicates. The fourth filler may comprise thirds by mass of calcium silicates (3 Ca)—SiO2 and 2 CaO—SiO2, and the remainder may comprise aluminum and iron containing clinker phases and other compounds. The ratio of CaO to SiO2 may be greater than 2. The magnesium oxide content (MgO) may be less than 5% by mass. In some examples, 95% of the particle size may be lower than 45 microns, with an average particle size of about 15 microns.

Embodiments of the fourth filler may comprise an average particle size of not greater than about 40 microns. For example, the fourth filler average particle size may be not greater than about 30 microns, or even not greater than about 20 microns. Non-limiting examples of the fourth filler average particle size can be at least about 1 micron, such as at least about 5 microns, or even least about 10 microns. The fourth filler average particle size may be within a range between any of the minimum and maximum values noted above.

Other examples of the abrasive portion may comprise a greater content of the first filler (vol %) as compared to a content of the fourth filler (vol %). The abrasive portion may comprise a ratio (V1/V4) of at least about 1, wherein V1 represents a content of the first filler (vol %) within the abrasive portion and V4 represents a content of the fourth filler (vol %) within the abrasive portion. Alternatively, the ratio (V1/V4) can be at least about 3, such as at least about 6, at least about 10, at least about 15, or even at least about 18. Other non-limiting embodiments of the ratio (V1/V4) can be not greater than about 40, such as not greater than about 35, not greater than about 30, or even not greater than about 25. The ratio (V1/V4) can be within a range between any of the minimum and maximum values noted above.

Examples of the abrasive portion may comprise a greater content of a second filler (vol %) as compared to a content of the fourth filler (vol %). The abrasive portion may comprise a ratio (V2/V4) of at least about 1, wherein V2 represents a content of the second filler (vol %) within the abrasive portion and V4 represents a content of the fourth filler (vol %) within the abrasive portion. In a particular embodiment, the ratio (V2/V4) can be at least about 3, such as at least about 6. Non-limiting examples of the ratio (V2/V4) can be not greater than about 40, such as not greater than about 35, not greater than about 30, not greater than about 25, or even not greater than about 20. The ratio (V2/V4) can be within a range between any of the minimum and maximum values noted above.

In still another embodiment, the abrasive portion may comprise a greater content of the fourth filler (vol %) as compared to a content of a third filler (vol %). The abrasive portion may comprise substantially the same content (vol %) of the third filler and the fourth filler. The abrasive portion may comprise a ratio (V3/V4) of at least about 0.2, wherein V3 represents a content of the third filler (vol %) within the abrasive portion and V4 represents a content of the fourth filler (vol %) within the abrasive portion. Other examples of the ratio (V3/V4) can be at least about 0.4, such as at least about 0.6, or even at least about 0.8. Other non-limiting embodiments of the ratio (V3/V4) can be not greater than about 1.8, such as not greater than about 1.5, not greater than about 1.4, or even not greater than about 1.3. The ratio (V3/V4) can be within a range between any of the minimum and maximum values noted above.

Examples of the abrasive portion may comprise a fourth filler (vol %). For example, the fourth filler can be at least about 1 vol % of a total volume of the fillers. Alternatively, the fourth filler can be at least about 2 vol % of the total volume of the fillers, such as at least about 2.5 vol %. Non-limiting embodiments of the fourth filler can be not greater than about 5 vol % of the total volume of the fillers, such as not greater than about 4.5 vol %, not greater than about 4 vol %, or even not greater than about 3.5 vol %. The vol % of the fourth filler in the total volume of the fillers can be within a range between any of the minimum and maximum values noted above.

In other embodiments, the abrasive portion may comprise a combination of the first filler, a second filler, a third filler, and a fourth filler. For example, the abrasive portion may comprise a total content of the first filler, second filler, third filler, and fourth filler of at least about 15 vol % for a total volume of the abrasive portion. Alternatively, the total content of the first filler, second filler, third filler, and fourth filler may be at least about 18 vol % of the total volume of the abrasive portion, such as at least about 20 vol %, at least about 22 vol %, or even at least about 25 vol %. Non-limiting embodiments may include the total content of the first filler, second filler, third filler, and fourth filler being not greater than about 40 vol % of the total volume of the abrasive portion, such as not greater than about 35 vol %, or even not greater than about 32 vol %. The filler content of the abrasive portion can be within a range between any of the minimum and maximum values noted above.

Embodiments of the abrasive portion also may comprise a wetting liquid remnant in the finished article. For example, the wetting liquid remnant may include an aliphatic chain. The aliphatic chain may be a remnant from tridodecyl alcohol (TDA). In another embodiment, the abrasive portion may comprise a wetting liquid remnant including cyclic organic molecules. The cyclic organic molecules may be a remnant from highly chlorinated wax, furfurol or Chloro 40.

The abrasive portion may comprise at least one wetting liquid, such as those described above, water, castor oil or a combination thereof. In some examples, the bond material may include TDA at at least about 5 ml/lb of bond material, such as at least about 10 ml/lb, or even at least about 15 ml/lb. In other non-limiting examples, the bond material may include TDA at not greater than about 25 ml/lb of bond material, such as not greater than about 20 ml/lb, or even not greater than about 18 ml/lb. The bond material content can be within a range between any of the minimum and maximum values noted above.

In other embodiments, the bond material may include Chloro 40 at at least about 0.5 ml/lb of bond material, such as at least about 1.0 ml/lb, or even at least about 1.5 ml/lb. In other non-limiting examples, the bond material may include Chloro 40 at not greater than about 5 ml/lb of bond material, such as not greater than about 4 ml/lb, or even not greater than about 3 ml/lb. The bond material content can be within a range between any of the minimum and maximum values noted above.

The body also may comprise a tapered region extending circumferentially around a portion of a periphery of the body. The tapered region may extend through the entire circumference of the body. Alternatively, the tapered region may extend radially from a flat region of the body. In addition, the tapered region of the body may comprise an average thickness that is greater than an average thickness of the flat region of the body. In a particular example, the body may comprise a central opening extending through a thickness of the body.

Some embodiments of the bond material in the abrasive cutting tool can be at least about 25 vol % of a total volume of the abrasive portion. For example, the bond material can be at least about 30 vol % of the total volume of the abrasive portion, such as at least about 35 vol %, or even at least about 40 vol %. In non-limiting embodiments, the bond material can be not greater than about 70 vol % of the total volume of the abrasive portion, such as not greater than about 60 vol %, not greater than about 55 vol %, or even not greater than about 50 vol %. The bond material content can be within a range between any of the minimum and maximum values noted above.

Embodiments of the body of the abrasive cutting tool may comprise a reinforcing member, such as a first reinforcing member. The first reinforcing member may abut the abrasive portion. The first reinforcing member may be disposed within the abrasive portion. Alternatively, the first reinforcing member may define an external surface of the body. In addition, the first reinforcing member may be disposed internally within the body.

Some embodiments of the first reinforcing member may comprise an organic material. In particular embodiments, the first reinforcing member may comprise a polyimide, polyamide, polyester, aramid, and a combination thereof. Alternatively, the first reinforcing member may comprise an inorganic material. For example, the inorganic material may comprise ceramic materials, glass materials, glass-ceramic materials, or a combination thereof. Alternatively, the first reinforcing member may comprise glass fibers, such as phenolic resin-coated glass fibers.

In still other versions, the first reinforcing member may extend through an entire diameter of the body. The first reinforcing member may comprise a planar member comprising a first major surface and a second major surface. The abrasive portion may overlie the first major surface. Alternatively, the abrasive portion can be in direct contact with the first major surface of the first reinforcing member.

Alternate embodiments of the body of the abrasive cutting tool may comprise a first reinforcing member and a second reinforcing member. The first reinforcing member and the second reinforcing member can be spaced apart from each other within the body. Alternatively, at least a portion of the abrasive portion may be disposed between the first reinforcing member and the second reinforcing member.

In a particular embodiment, the abrasive portion may comprise abrasive grains that may be at least about 30 vol % of a total volume of the abrasive portion. In some instances the abrasive grains may be at least about 36 vol % of the total volume of the abrasive portion, such as at least about 40 vol %, at least about 44 vol %, or even at least about 48 vol %. In certain non-limiting embodiments, the abrasive grains may be not greater than about 65 vol % of the total volume of the abrasive portion, such as not greater than about 60 vol %, not greater than about 58 vol %, not greater than about 54 vol %, or even not greater than about 50 vol %. The total volume of the abrasive portion can have an abrasive grain content within a range between any of the minimum and maximum values noted above.

Embodiments of the abrasive particles also may comprise a coating. The coating may comprise, for example, a ceramic, a metal, a transition metal element, iron, an oxide, a metal oxide, or even an iron oxide.

In some embodiments, abrasive portion can include a mixture of more than one type of shaped abrasive particle. For example, the abrasive portion can include a the first type of abrasive particle comprises brown fused alumina (BFA), or may consist essentially of BFA. For example, the first type of particle may comprise Treibacher BFA. BFA may comprise oxides, such as BaO, CaO, $Na_2O$, $P_2O_5$, and a combination thereof. For example, BFA may comprise about 1360 to about 1560 PPM BaO. BFA also may comprise about 4940 to about 5140 PPM CaO. BFA also may comprise about 820 to about 1020 PPM $Na_2O$. BFA also may comprise less than about 50 PPM $P_2O_5$.

In some examples of the abrasive cutting tool, the BFA may comprise not greater than about 99 vol % $Al_2O_3$. In other examples, the BFA may comprise not greater than about 98 vol % $Al_2O_3$, such as not greater than about 97 vol % $Al_2O_3$. In other non-limiting examples, the BFA may be at least about 80 vol % $Al_2O_3$, such as at least about 85 vol % $Al_2O_3$, or even at least about 90 vol % $Al_2O_3$. The BFA of the abrasive cutting tool can have a $Al_2O_3$ content within a range between any of the minimum and maximum values noted above.

In an alternate embodiment of the abrasive cutting tool, the BFA may comprise not greater than about 20 vol % $ZrO_2$. For example, the BFA may be not greater than about 15 vol % $ZrO_2$, such as not greater than about 10 vol % $ZrO_2$, not greater than about 5 vol % $ZrO_2$, or even not greater than about 1 vol % $ZrO_2$. Other non-limiting embodiments of the BFA may have at least about 0.01 vol % $ZrO_2$, such as at least about 0.05 vol % $ZrO_2$, or even at least about 0.10 vol % $ZrO_2$. The BFA of the abrasive cutting tool can have a $ZrO_2$ content within a range between any of the minimum and maximum values noted above.

In another particular instance, the BFA may have a hardness not greater than about 20 GPa. For example, the BFA may have a hardness of not greater than about 19 GPa, such as not greater than about 18 GPa, or even not greater than about 17 GPa. Alternate non-limiting embodiments may include the BFA having a hardness of at least about 15.5 GPa, such as at least about 15.8 GPa, or even at least about 16 GPa. The BFA of the abrasive cutting tool can have a hardness within a range between any of the minimum and maximum values noted above.

In an example of a test for hardness, the sample grains are mounted in epoxy and then polished. Once the grains are mounted and polished a desired load is selected on the hardness tester for indentation. The load typically selected is 500 g, but a load of 1 kg also may be selected depending on the strength of the grains. Once the indent is done, a diamond-shaped indent appears and measurements are made to determine hardness.

Friability may be defined by the relative breakdown of a sample compared to a standard. Typically friability may be measured by ball milling grain for a given time, which is the same time used to ball mill a standard grain. After milling the residual grain/powder is screened and the amount of grain that has broken down is weighed. These measurements are compared to the starting amount of grain and then compared to the breakdown of the standard. This allows relative comparison of grain durability.

For example, ball mill friability may be measured by putting a given amount of grain in a ball mill container with media (e.g., tungsten carbide) and milling for a set time. Typically the time is dependent on when the standard or baseline grain reaches about 50% breakdown. This means 50% of the starting weight of the grain can pass through a small opening screen.

The standard for friability may be chosen based on the grain being tested. For example if a very friable grain (i.e., it breaks down more easily) is being considered, a standard would be chosen with like-friability. For BFA samples a more durable alumina standard may be chosen. The standard chosen also depends on the application to determine relevance of the standard.

Embodiments of the BFA also may have a friability of not greater than about 70% of the standard. For example, the BFA may have a friability of not greater than about 65%, such as not greater than about 60%. Non-limiting embodiments of the BFA may have a friability of at least about 20%, such as at least about 30%, at least about 40%, or even at least about 50%. The BFA of the abrasive cutting tool can have a friability within a range between any of the minimum and maximum values noted above. The classic alundum grain can be 70% more friable than the blue fired alumina.

The abrasive particles of the mixture and the final-formed abrasive article may include more than one type of abrasive particle. For example, the mixture can include a second type of abrasive particle different than the first type of abrasive particle. The second type of abrasive particle can differ from the first type of abrasive particle by any one of a composition, a mechanical property (e.g., hardness, friability, etc.), particle size, a method of making, or a combination thereof.

For example, the second type of abrasive particle may comprise alumina, zirconia or alumina and zirconia. The second type of abrasive particle may comprise essentially alumina and zirconia.

The second type of particle may comprise blue fired alumina (BLFA). For example, the second type of particle may comprise Treibacher blue fired alumina.

In some examples of the abrasive cutting tool, the BLFA may comprise not greater than about 95.3 vol % $Al_2O_3$. In other examples, the BLFA may comprise not greater than about 95.2 vol % $Al_2O_3$, such as not greater than about 95.1 vol % $Al_2O_3$. In other non-limiting examples, the BLFA may be at least about 80 vol % $Al_2O_3$, such as at least about 85 vol % $Al_2O_3$, or even at least about 90 vol % $Al_2O_3$. The BLFA of the abrasive cutting tool can have a $Al_2O_3$ content within a range between any of the minimum and maximum values noted above.

In an alternate embodiment of the abrasive cutting tool, the BLFA may comprise not greater than about 20 vol % $ZrO_2$. For example, the BLFA may be not greater than about 15 vol % $ZrO_2$, such as not greater than about 10 vol % $ZrO_2$, not greater than about 5 vol % $ZrO_2$, or even not greater than about 1 vol % $ZrO_2$. Other non-limiting embodiments of the BLFA may have at least about 0.16 vol % $ZrO_2$, such as at least about 0.17 vol % $ZrO_2$, or even at least about 0.18 vol % $ZrO_2$. The BLFA of the abrasive cutting tool can have a $ZrO_2$ content within a range between any of the minimum and maximum values noted above.

BLFA may comprise oxides, such as BaO, CaO, $Na_2O$, $P_2O_5$, and a combination thereof. For example, BLFA may include not greater than about 1200 PPM BaO, such as not greater than about 800 PPM BaO, not greater than about 400 PPM BaO, or even not greater than about 200 PPM BaO.

Embodiments of BLFA also may include not greater than about 4000 PPM CaO. For example, BLFA can be not greater than about 3000 PPM CaO, such as not greater than about 2000 PPM CaO.

Other embodiments of BLFA also may include not greater than about 800 PPM $Na_2O$. For example, BLFA can be not greater than about 400 PPM $Na_2O$, such as not greater than about 200 PPM $Na_2O$.

Still other embodiments of BLFA may include greater than about 50 PPM $P_2O_5$. For example, BLFA can be greater than about 100 PPM $P_2O_5$, such as greater than about 500 PPM $P_2O_5$, or even greater than about 1000 PPM $P_2O_5$.

In contrast to BLFA, embodiments of BFA may contain very different amounts of oxides described above for BLFA. For example, BFA may include at least about 200 PPM BaO, such as at least about 500 PPM BaO, or even at least about 1000 PPM BaO.

Embodiments of BFA also may include greater than about 2000 PPM CaO. For example, BFA can be greater than about 3000 PPM CaO, such as greater than about 4000 PPM CaO.

Other embodiments of BFA also may include greater than about 200 PPM $Na_2O$. For example, BFA can be greater than about 400 PPM $Na_2O$, such as greater than about 800 PPM $Na_2O$.

Still other embodiments of BFA may include not greater than about 50 PPM $P_2O_5$. For example, BFA can be not greater than about 40 PPM $P_2O_5$, such as not greater than about 30 PPM $P_2O_5$, or even not greater than about 20 PPM $P_2O_5$.

In other embodiments, the second type of abrasive particle may comprise not greater than about 90 vol % $Al_2O_3$. For example, the second type of abrasive particle may not be greater than about 85 vol % $Al_2O_3$, such as not greater than about 80 vol % $Al_2O_3$. Non-limiting embodiments of the second type of abrasive particle may be at least about 70 vol % $Al_2O_3$, such as at least about 65 vol % $Al_2O_3$, or even at least about 60 vol % $Al_2O_3$. The second type of abrasive particle can have a $Al_2O_3$ content within a range between any of the minimum and maximum values noted above.

In another embodiment, the second type of abrasive particle may comprise not greater than about 40 vol % $ZrO_2$. Other examples of the second type of abrasive particle may be not greater than about 35 vol % $ZrO_2$, such as not greater than about 30 vol % $ZrO_2$, or even not greater than about 25 vol % $ZrO_2$. Non-limiting examples of the second type of abrasive particle may be at least about 10 vol % $ZrO_2$, such as at least about 15 vol % $ZrO_2$, or even at least about 20 vol % $ZrO_2$. The second type of abrasive particle can have a $ZrO_2$ content within a range between any of the minimum and maximum values noted above.

Other embodiments of the second type of abrasive particle may have a hardness not greater than about 20 GPa. For example, the second type of abrasive particle may have a hardness not greater than about 18 GPa, such as not greater than about 17 GPa, or even not greater than about 16 GPa. Non-limiting examples of the second type of abrasive particle may have a hardness of at least about 14 GPa, such as at least about 14.5 GPa, or even at least about 15 GPa. The second type of abrasive particle can have a hardness within a range between any of the minimum and maximum values noted above.

In another example, the second type of abrasive particle may have a friability of not greater than about 20%. In a particular instance, the second type of abrasive particle may have a friability of not greater than about 15%, such as not greater than about 10%. Non-limiting embodiments of the second type of abrasive particle may have a hardness of at least about 2%, such as at least about 4%, at least about 5%, or even at least about 6%. The second type of abrasive particle can have a friability within a range between any of the minimum and maximum values noted above.

According to another embodiment, the abrasive particles can be shaped abrasive particles. Shaped abrasive particles can have a well-defined and regular arrangement (i.e., non-random) of edges and sides, thus defining an identifiable shape. For example, a shaped abrasive particle may have a polygonal shape as viewed in a plane defined by any two dimensions of length, width, and height. Some exemplary polygonal shapes can be triangular, quadrilateral (e.g., rectangular, square, trapezoidal, parallelogram), a pentagon, a hexagon, a heptagon, an octagon, a nonagon, a decagon, and the like. Additionally, the shaped abrasive particle can have a three-dimensional shape defined by a polyhedral shape, such as a prismatic shape or the like. Further, the shaped abrasive particles may have curved edges and/or surfaces, such that the shaped abrasive particles can have convex, concave, ellipsoidal shapes.

The shaped abrasive particles can be in the form of any alphanumeric character, e.g., 1, 2, 3, etc., A, B, C. etc. Further, the shaped abrasive particles can be in the form of a character selected from the Greek alphabet, the modern Latin alphabet, the ancient Latin alphabet, the Russian alphabet, any other alphabet (e.g., Kanji characters), and any combination thereof.

The shaped abrasive particle can have a body defining a length (l), a height (h), and a width (w), wherein the length is greater than or equal to the height, and the height is greater than or equal to the width. Further, in a particular aspect, the body may include a primary aspect ratio defined by the ratio of length:height of at least about 1:1. The body may also include an upright orientation probability of at least about 50%.

In another aspect, the shaped abrasive particle can have a body having a length (l), a width (w), and a height (h), wherein the length, width, and height may correspond to a longitudinal axis, a lateral axis, and a vertical axis, respectively, and the longitudinal axis, lateral axis, and vertical axis may define three perpendicular planes. In this aspect, the body may include an asymmetric geometry with respect to any of the three perpendicular planes.

In yet another aspect, the shaped abrasive particle may include a body having a complex three-dimensional geometry including 3-fold symmetry in three perpendicular planes defined by a longitudinal axis, a lateral axis, and a vertical axis. Further, the body may include an opening that extends through the entire interior of the body along one of the longitudinal axis, lateral axis, or vertical axis.

In still another aspect, the shaped abrasive particle may include a body having a complex three-dimensional geometry defined by a length (l), a width (w), and a height (h). The body may also include a center of mass and a geometric midpoint. The center of mass may be displaced from the geometric midpoint by a distance (Dh) of at least about 0.05 (h) along a vertical axis of the body defining the height.

In another aspect, the shaped abrasive particle may include a body that defines a length (l), a width (w), and a height (h). The body may include a base surface and an upper surface. Further, the base surface comprises a different cross-sectional shape than a cross-sectional shape of the upper surface.

In still another aspect, the shaped abrasive particle may include a body that has a generally flat bottom and a dome shaped top extending from the generally flat bottom.

In another aspect, the shaped abrasive particle may include a body comprising a length (l), a width (w), and a height (h). The length, width, and height may correspond to a longitudinal axis, a lateral axis, and a vertical axis, respectively. Further, the body may include a twist along a longitudinal axis defining the length of the body such that a base surface is rotated with respect to an upper surface to establish a twist angle.

In yet another aspect, the shaped abrasive particle may include a body having a first end face and a second end face a, at least three adjacent side faces extending between the first end face and the second end face, and an edge structure established between each pair of adjacent side faces.

In another aspect, the shaped abrasive particle may include a body having a central portion and at least three radial arms extending outwardly from the central portion along the entire length of the central portion.

The abrasive cutting tool may comprise embodiments wherein the bond material comprises resin. The resin can be at least about 40 vol % of a total volume of the bond material. In other examples, the resin may be at least about 45 vol % of the total volume of the bond material, such as at least about 50 vol %, or even at least about 55 vol %. In other non-limiting embodiments, the resin can be not greater than about 90 vol % of the total volume of the bond material, such as not greater than about 80 vol %, or even not greater than 75 vol %. The resin content can be within a range between any of the minimum and maximum values noted above.

In other embodiments of the abrasive cutting tool, the bond material comprises a resin having a high temperature flexure modulus of at least 1.05. In other embodiments the bond material may comprise a resin having an increasing high temperature flexural modulus.

In some embodiments, the resin used in the bond material may comprise an organic resin. In other embodiments, the resin may comprise a phenolic resin. In still other embodiments, the phenolic resin may be modified with a curing or cross-linking agent, such as hexamethylene tetramine. At temperatures in excess of about 90° C., some examples of the hexamethylene tetramine may form crosslinks to form methylene and dimethylene amino bridges that help cure the resin. The hexamethylene tetramine may be uniformly dispersed within the resin. More particularly, hexamethylene tetramine may be uniformly dispersed within resin regions as a cross-linking agent. Even more particularly, the phenolic resin may contain resin regions with cross-linked domains having a sub-micron average size.

Embodiments of the abrasive cutting tool also may comprise the body having a K2SO4 (or CVR) index of at least about 1% greater than a body of a conventional abrasive cutting tool. The CVR Index may comprise the formula:

$$[(CVR1-CVR2)/CVR1]\times 100\%$$

wherein CVR1 is a CVR surface coverage of the body, and CVR2 is a CVR surface coverage of the body of the conventional abrasive cutting tool.

The values CVR1 and CVR2 may be determined by a CVR determination method. For example, a sample abrasive article (e.g., a sample of an abrasive cutting wheel) may be exposed to 75 kW for 20 minutes under a cone calorimeter experiment per ISO 5660. The sample is then surface mapped with an SEM/EDX instrument for the formation of CVR or K2SO4 on the surface of the sample.

In some examples, the CVR index of the body can be at least about 5% greater than the body of the conventional abrasive cutting tool. Alternatively, the CVR index can be at least about 10% greater than the body of the conventional abrasive cutting tool, such as at least about 20% greater, at least about 30% greater, at least about 40% greater, at least about 50% greater at least about 60% greater, at least about 70% greater, or even at least about 80% greater than the body of the conventional abrasive cutting tool. The CVR index can be within a range between any of the minimum and maximum values noted above.

In other examples of the abrasive cutting tool, the CVR index of the body is not greater than about 90% greater than the body of the conventional abrasive cutting tool. For example, the CVR index of the body can be not greater than about 80% greater than the body of the conventional abrasive cutting tool, such as no greater than about 70% greater, not greater than about 60% greater, not greater than about 50% greater, not greater than about 40% greater, not greater than about 30% greater, not greater than about 20% greater, or even not greater than about 10% greater than the body of the conventional abrasive cutting tool. The CVR index can be within a range between any of the minimum and maximum values noted above.

In some embodiments, the body may have a Thermal Adhesion Factor (TAF) of at least about 30%. In other embodiments, the TAF of the body is at least about 33%, at least about 36%, at least about 39%, at least about 42%, not greater than 100%, not greater than 75%, or even not greater than 50%.

The TAF can be within a range between any of the minimum and maximum values noted above.

In addition, the body of the abrasive cutting tool may comprise a baseline Adhesion Value (AVb) of at least about 550 lbf, at least about 575 lbf, at least about 600 lbf, at least about 625 lbf, at least about 650 lbf, and not greater than about 800 lbf, not greater than about 750 lbf, or even not greater than about 700 lbf. The AVb can be within a range between any of the minimum and maximum values noted above.

Moreover, the body of the abrasive cutting tool may comprise a thermal treatment Adhesion Value (AVtt) of at least about 150 lbf, at least about 175 lbf, at least about 200 lbf, at least about 225 lbf, at least about 250 lbf, at least about 275 lbf, and not greater than about 400 lbf, not greater than about 350 lbf, or even not greater than about 300 lbf. The AVtt can be within a range between any of the minimum and maximum values noted above.

Example

Samples S1 and S2 were prepared and are identical with regard to grain blend, grade and structure, bond system according to an embodiment herein, and wheel construction. Sample S1 and S2 comprised 48% abrasive, 44% bond, and 8% pores. The grain blend was 15% ZF grain and 85% brown fused alundum.

Samples S1 and S2 are distinct from each other based upon their reinforcing members. Sample S1 included IPAC-standard 2024 reinforcing members, while sample S2 included SGTF-450 reinforcing members, commercially available from Adfors. Construction details regarding the reinforcing member for sample S1 include a thickness of about 0.030 inches (0.762 mm). The reinforcing member comprised about 15 vol % of a total volume of the body. The reinforcing member may comprise about 15 vol % to 25 vol % of the total volume of the body. The reinforcing member comprises fiber bundles with openings therebetween, and the openings comprise an area of 9 $mm^2$ (i.e., 3×3 mm). The reinforcing member comprises fiber bundles have a warp filament diameter of 17 microns.

Differential Scanning calorimetry (DSC) measures the temperatures and heat flows associated with transitions in materials as a function of time and temperature in a controlled atmosphere. These measurements provide quantitative and qualitative information about physical and chemical changes that involve endothermic or exothermic processes, or changes in heat capacity. DSC was measured using approximately a 25 g sample of fiberglass in a nitrogen environment. The sample was ramped to 400° C. at a ramp of 10° C./min and held for 10 minutes. For sample S1, the reinforcing member had a DSC enthalpy of reaction of about 29 J/g, and a DSC enthalpy of crystallization of 30 J/g.

Construction details regarding the reinforcing member for sample S2 include a thickness of about 0.762 mm (range: about 0.5 mm to about 2.5 mm). The reinforcing member comprises 12 vol % of a total volume of the body (range is about 9 vol % to about 15 vol %). The reinforcing member comprises fiber bundles with openings therebetween, and the openings comprise an area of 16 $mm^2$ (i.e., 4×4 mm). The reinforcing member comprises fiber bundles have a warp filament diameter of 9 or 12 microns. The same DSC tests described above were performed on sample S2. The S2 reinforcing member had a DSC enthalpy of reaction of about 15 J/g, and a DSC enthalpy of crystallization of 2 J/g.

Figure 4A:
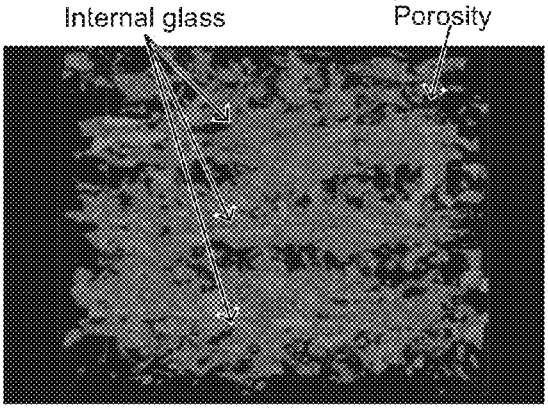
FIGS. 4A and 4B include CT images of abrasive tools illustrating porosity with a conventional reinforcing member and an embodiment, respectively.
Figure 4B:
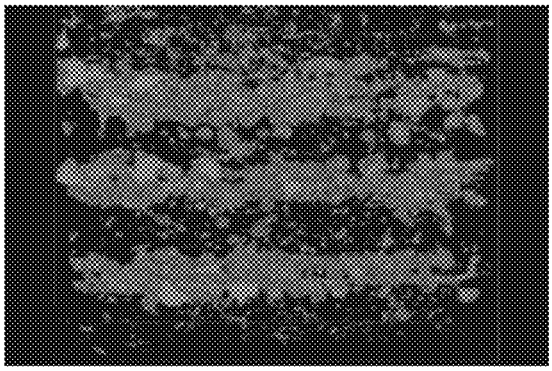

FIGS. 4A and 4B include computed tomography (CT) images of abrasive tools illustrating porosity with samples S1 and S2, respectively. The microstructure of sample S2 is significantly better than that of sample S1. Although the fiberglass layers are difficult to differentiate, the porosity distribution is clearly shown. Sample S1 has significantly more porosity around the glass webs.

Figure 5A:
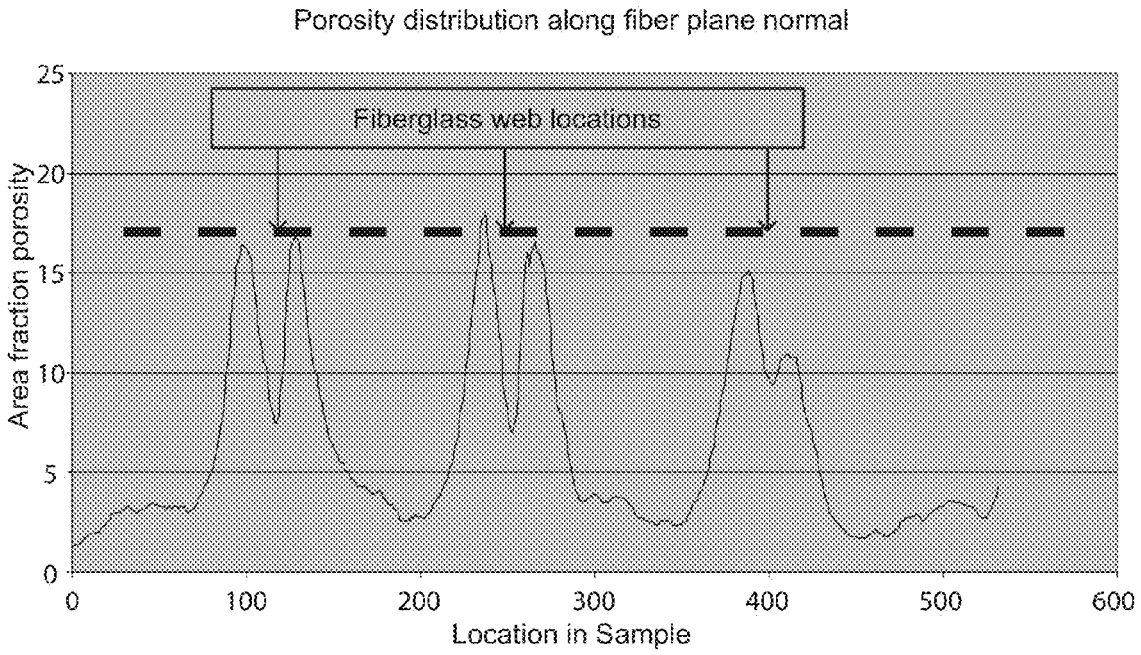
FIGS. 5A and 5B include plots of porosity in abrasive tools having conventional reinforcing members and an embodiment, respectively.
Figure 5B:
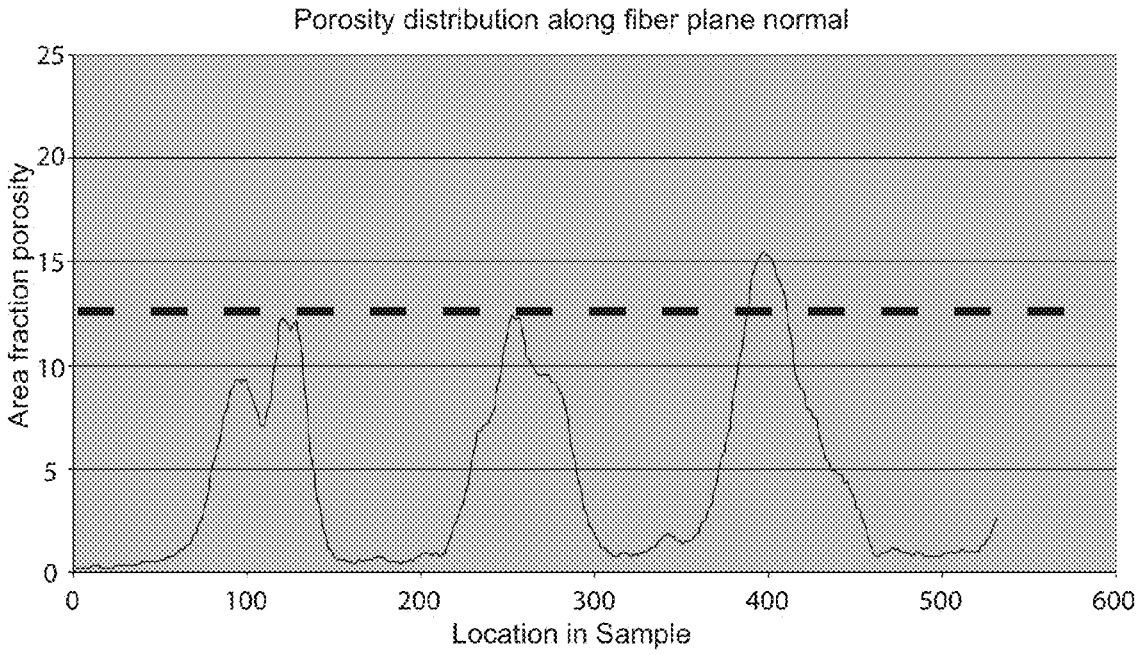

FIGS. 5A and 5B include plots of porosity in abrasive tool samples S1 and S2, respectively. These plots compare area fraction porosity (y-axis) as a function of axial location or thickness (x-axis) in the samples. There is clearly a higher percentage of porosity around the glass web in sample S1 than sample S2. After integration of the porosity, it was observed that samples S1 had between 6 vol % and 9 vol % porosity, whereas the porosity of samples S2 was reduced to 4 vol % to 5 vol %.

Thus, the body may comprise not greater than about 8 vol % porosity for the total volume of the body, not greater than about 7 vol %, not greater than about 6 vol %, not greater than about 5 vol %, not greater than about 4.5 vol %, at least about 0.001 vol %, at least about 0.01 vol %, at least about 2 vol %.

At the interface between the reinforcing member and the abrasive portion the body has a Maximum Porosity Index (MPI) that may be calculated by subtracting the peak value from the minimum valley value, and then dividing the difference by the minimum valley value. These calculations are based on a graph obtained by conducting a scan of the material under particular conditions. The MPI is based on the largest difference from the curve of a minimum corresponding to a position of the reinforcing member positioned between two maximums, indicating interfacial porosity at the interface of the abrasive portion and the reinforcing member.

For example, in FIG. 5A the peak value is 18% and is found adjacent the middle reinforcing member. The minimum valley value in FIG. 5A is 7%. Thus, the maximum porosity index (MPI) for FIG. 5A is (18−7)/7]×100%=157%. In contrast, the maximum porosity index (MPI) of FIG. 5B is found adjacent the left reinforcing member and is (12−7.5)/7.5]×100%=60%.

Thus, at an interface between the reinforcing member and the abrasive portion, the body may have a Maximum Porosity Index of less than about 150%, less than about 125%, less than about 100%, less than about 90%, less than about 80%.

In addition, the dashed horizontal lines extending across FIGS. 5A and 5B portray the average area fraction porosity of each is about 12% and 17.5%, respectively, at an interface with the reinforcing member. Thus, the body may have an average area fraction porosity of not greater than about 16% at an interface with the reinforcing member, not greater than about 15%, not greater than about 14%, not greater than about 13%; at least about 4%, at least about 8%, at least about 12%.

Figure 6A:
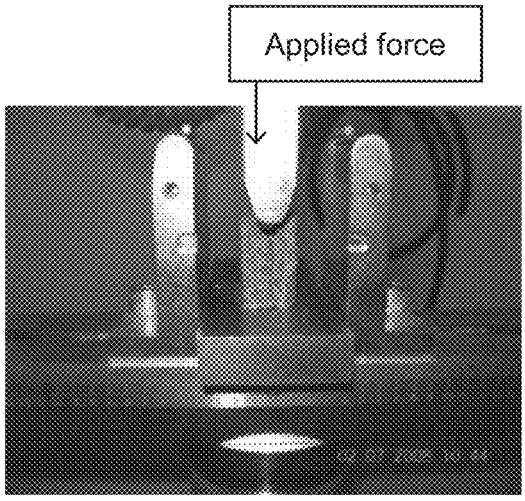
FIGS. 6A, 6B and 6C include images of an adhesion measure test of a sample abrasive tool.
Figure 6B:
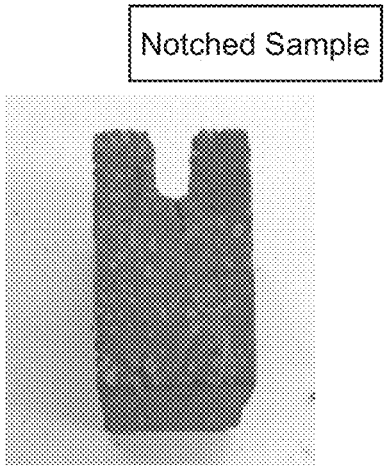
Figure 6C:
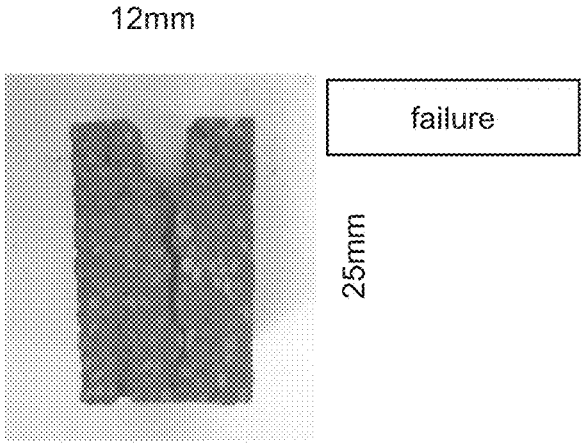

FIGS. 6A, 6B and 6C include images of an adhesion measure test (i.e., Thermal Adhesion Factor (TAF)) performed on samples S1 and S2. Each sample was notched as shown in FIG. 6B. The samples were then placed in a fixture as shown in FIG. 6A. Force is applied to the notched samples and the force needed to split the sample (FIG. 6C) is used to compare adhesion at the glass web interface.

The adhesion of each sample was tested before and after a heat soak. The samples were heated to 400° C. and held for 2 hours and then measured for adhesion. Adhesion as a function of heat soak time appears in Table 1.

TABLE 1

| | | Adhesion (lbf) | % of baseline |
|---|---|---|---|
| Samples S2 | Baseline (AVb) | 678 | Baseline |
| | 120 min at 400° C. (AVtt) | 291 | 43% |

TABLE 1-continued

| | | Adhesion (lbf) | % of baseline |
|---|---|---|---|
| Samples S1 | Baseline (AVb) | 530 | Baseline |
| | 120 min at 400° C. (AVtt) | 136 | 26% |

The data shown in Table 1 shows the adhesion change as a function of soak time at 400° C. relative to baseline measurements taken at room temperature. To determine thermal resistance samples were placed in a 400° C. oven and allowed to soak for 120 minutes. After soaking, the samples were removed from the oven and allowed to cool. Adhesion was then measured on all samples and compared to the baseline. Samples S1 retained only 26% of the baseline adhesion, while samples S2 retained 43% of the baseline adhesion. Data was taken on a sample size of ten measurements at each condition. Sample S2 shows an improvement in TAF or thermo degradation resistance compared to sample S1.

Figure 7:
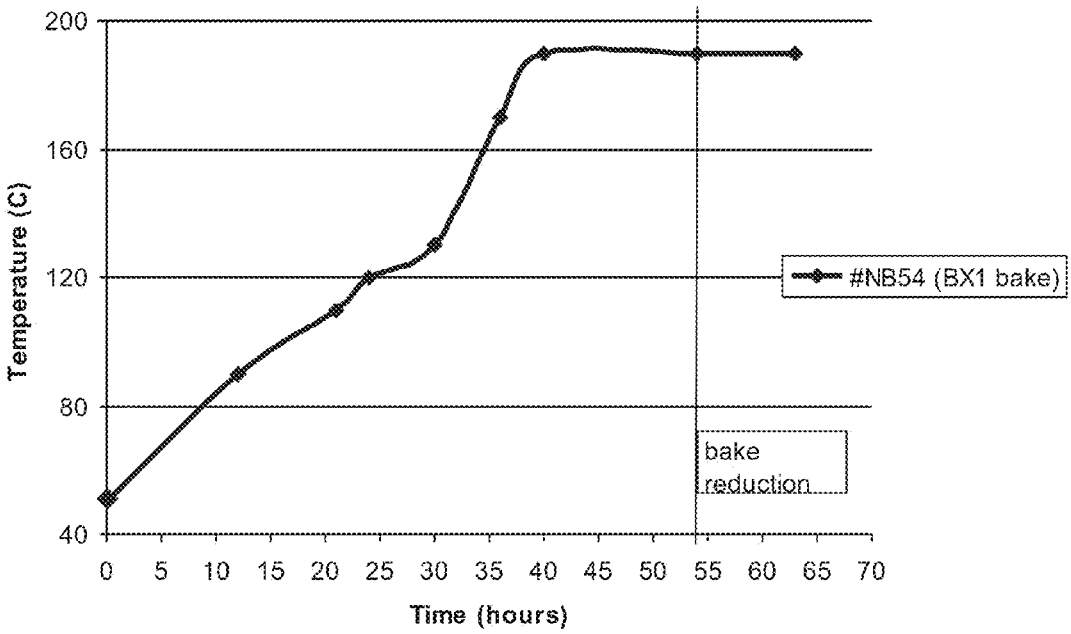
FIG. 7 includes a plot of a bake profiles for an embodiment of an abrasive tool.

FIG. 7 includes a plot of a bake profile for embodiment S2 of the abrasive wheel, described above. Conventional samples did not present any bake problems when its reinforcing members were changed from a standard IPAC glass to the glass of sample S2. The same bake cycle performed well for all types of fiberglass webs tested in conventional samples. However, substitution of the new glass into sample S2 and its higher temperature bake cycle generated significant geometry issues for the samples.

Figure 8A:
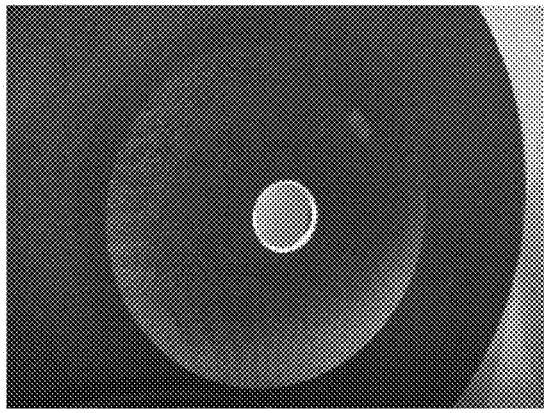
FIGS. 8A and 8B include photographs of unacceptable and acceptable products, respectively, formulated in accordance with embodiments herein.
Figure 8B:
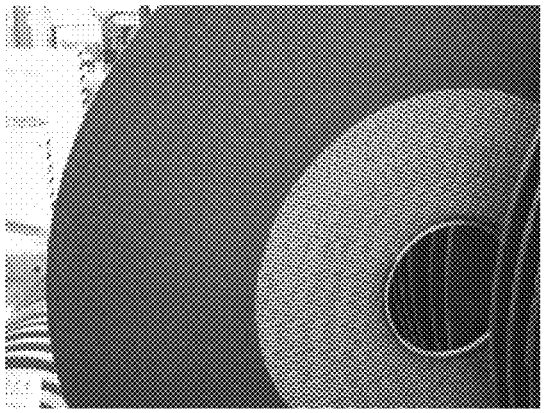

As shown in FIG. 7, the bake cycle for sample S2 with the conventional fiberglass webs originally lasted 63 hours at a maximum soak temperature of 190° C. Sample S2 with standard fiberglass webs had a rejection rate of approximately 10% based on geometry, the new fiber glass composite caused a strong shift in geometry leading to a 90% rejection rate. See FIGS. 8A and 8B for photographs comparing unacceptable and acceptable product, respectively.

To remediate this problem, the bake cycle for samples containing the new web was decreased by 9 hours. In addition, the clamping weight used was increased by a factor of 1.5 (i.e., 1800 kg instead of 1200 kg). This corresponds to approximately 0.4 kg/cm$^2$ for 1560 mm diameter wheels. With these changes the geometry of ensuing samples S2 with the new web was 100% within tolerance. In conclusion, there were clear differences in behavior between standard (IPAC) fiberglass and the new fiberglass observed in conjunction with a higher temperature bake. Thus, processing changes were necessary due to the compositional and structural differences of the various embodiments.

The new fiberglass appears to be more sensitive to temperature than standard fiberglass, leading to a progressive shrinkage during the bake. By reducing the bake time, this impact was reduced while maintaining acceptable curing conditions and thermo mechanical characteristics.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive cutting tool, comprising:

a body in a shape of a large diameter disk having an outer diameter of at least about 60 centimeters, and an aspect ratio defined as a ratio (D:T) between the outer diameter to an axial thickness of the body of at least about 10:1, and the body including an abrasive portion having:

a bond material;

abrasive particles contained within the bond material;

a first filler contained within the abrasive portion comprising iron and sulfur having an average particle size of not greater than about 40 microns;

wherein the body further comprises a reinforcing member; and a Thermal Adhesion Factor (TAF) of at least about 30%.

2. The abrasive cutting tool of claim 1, wherein the TAF of the body is at least about 33%, and not greater than 100%.

3. The abrasive cutting tool of claim 1, wherein the body comprises a baseline Adhesion Value (AVb) of at least about 550 lbf, and not greater than about 800 lbf.

4. The abrasive cutting tool of claim 1, wherein the body comprises a thermal treatment Adhesion Value (AVtt) of at least about 150 lbf, and not greater than about 400 lbf.

5. The abrasive cutting tool of claim 1, wherein the body comprises not greater than about 8 vol % porosity for the total volume of the body.

6. The abrasive cutting tool of claim 1, wherein at an interface between the reinforcing member and the abrasive portion the body has a Maximum Porosity Index of less than about 150%.

7. The abrasive cutting tool of claim 1, wherein the body has an average area fraction porosity of not greater than about 16% at an interface with the reinforcing member.

8. The abrasive cutting tool of claim 1, wherein the reinforcing member comprises an opening that defines an open area of at least about 10 $mm^2$ within a major plane of the reinforcing member, wherein the opening defines an open area of not greater than about 20 $mm^2$ within a major plane of the reinforcing member.

9. The abrasive cutting tool of claim 1, wherein the reinforcing member comprises fiber bundles having a warp filament diameter of less than about 17 microns.

10. The abrasive cutting tool of claim 1, wherein the reinforcing member comprises a DSC enthalpy of reaction less than about 29 J/g.

11. The abrasive cutting tool of claim 1, wherein the reinforcing member comprises a DSC enthalpy of crystallization less than about 30 J/g.

12. The abrasive cutting tool of claim 1, wherein the abrasive particles comprise a first type of abrasive particle and a second type of abrasive particle different than the first type, wherein the first type of abrasive particle comprises brown fused alumina (BFA) wherein the abrasive particles comprise a coating, wherein the coating comprises iron oxide.

13. The abrasive cutting tool of claim 1, wherein the first filler comprises pyrite ($FeS_2$).

14. The abrasive cutting tool of claim 1, wherein the abrasive portion comprises a wetting liquid remnant including an aliphatic chain, wherein the abrasive portion comprises a wetting liquid remnant including cyclic organic molecules.

15. The abrasive cutting tool of claim 1, wherein the body comprises a tapered region extending circumferentially around a portion of a periphery of the body, wherein the tapered region extends through the entire circumference of the body, wherein the tapered region extends radially from a flat region of the body, wherein the tapered region of the body comprises an average thickness that is greater than an average thickness of the flat region of the body, wherein the body comprises a central opening extending through a thickness of the body.

16. The abrasive cutting tool of claim 1, wherein the abrasive particles comprise brown fused alumina (BFA) having a hardness not greater than about 20 GPa and at least about 15.5 GPa.

17. The abrasive cutting tool of claim 1, wherein the abrasive particles comprise brown fused alumina (BFA) having a friability of not greater than about 70%, and at least about 20%.

18. The abrasive cutting tool of claim 1, wherein the bond material comprises resin, and the resin is at least about 40 vol % of a total volume of the bond material, and not greater than about 90 vol %.

19. The abrasive cutting tool of claim 1, wherein the bond material comprises a resin having a high temperature flexure modulus of at least 1.05, wherein the bond material comprises a resin having an increasing high temperature flexural modulus.

20. The abrasive cutting tool of claim 1, wherein the bond material is at least about 40 vol % and not greater than about 50 vol % of a total volume of the body.

21. The abrasive cutting tool of claim 1, wherein the TAF of the body is at least about 39%, and not greater than 75%.

* * * * *